US006663432B2

(12) United States Patent
Inagawa

(10) Patent No.: US 6,663,432 B2
(45) Date of Patent: Dec. 16, 2003

(54) SHIELDED CABLE CONNECTOR AND ELECTRONIC DEVICE

(75) Inventor: Hideho Inagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,319

(22) Filed: Mar. 27, 2002

(65) Prior Publication Data

US 2002/0142633 A1 Oct. 3, 2002

(30) Foreign Application Priority Data

Apr. 2, 2001 (JP) ..... 2001-103643
Mar. 14, 2002 (JP) ..... 2002-070322

(51) Int. Cl.[7] ..... H01R 9/03
(52) U.S. Cl. ..... 439/610; 439/607
(58) Field of Search ..... 439/98, 607, 610, 439/95, 108

(56) References Cited

U.S. PATENT DOCUMENTS 3,910,665 A * 10/1975 Stull ..... 439/63
4,412,717 A * 11/1983 Monroe ..... 439/582
4,598,961 A * 7/1986 Cohen ..... 439/63
4,605,269 A * 8/1986 Cohen et al. ..... 439/63
4,664,467 A * 5/1987 Tengler et al. ..... 439/581
5,046,966 A * 9/1991 Snyder et al. ..... 439/579
6,210,228 B1 * 4/2001 Simmel et al. ..... 439/609

FOREIGN PATENT DOCUMENTS

JP 5-94849 4/1993

* cited by examiner

*Primary Examiner*—Tulsidas Patel
(74) *Attorney, Agent, or Firm*—Fitzpatrick, Cella, Harper & Scinto

(57) ABSTRACT

This invention is directed to provide a shielded cable connector that can stabilize electrical connection between a cable-side shield member and a board-side ground pattern. In order to achieve this object, a shielded cable connector to be mounted on a shielded cable having a signal transmission line and a shield member around it includes a metal outer shell member to come into direct contact with the shield member. The outer shell member includes a contact portion extended to come into direct contact with a ground pattern of an electric board to which the shielded cable is to be connected.

12 Claims, 15 Drawing Sheets

SHIELDED CABLE CONNECTOR AND ELECTRONIC DEVICE

FIELD OF THE INVENTION

The present invention relates to a shielded cable connector and an electronic device that can ensure stable operation of a transmission signal and can realize low radiation noise characteristics.

BACKGROUND OF THE INVENTION

As a color, high-resolution signal is introduced as an image signal, a large amount of data is transmitted and received between circuit wiring boards and units at high speed, and use of a cable with a multi-pin connector increases as a means of interface for such data transmission and reception. When such a cable with a multi-pin connector is used particularly for signal transmission outside a device, it often causes problems in terms of radiation noise and immunity (electromagnetic interference (susceptible to it)). To prevent this, a shielded cable in which the cable portion is covered with a shield member is used. The connection state of the shield member at the connector portion, the connection state of metal members particularly when the metal shell of the connector is divided into an outer shell metal member (outer shell) and inner metal member (inner shell), and the connection state between the fitting portion of the cable-side connector and that of the board-side connector largely fluctuate the electrical characteristics to sometimes cause variations in products (variations in EMI (radiation noise) characteristics of the products). In fact, regarding the electrical connection of the connector portion, it is generally considered that it suffices if electrical connection is obtained at least at one point, and a structure that enables stable electrical connection positively is not employed. In general, the smaller the number of connection points of the shield member, the lower the quality and stability of ground connection that influences the EMI characteristics.

The non-stability of the electrical connection from the shield member to a printed wiring board or metal housing, to which a metal shell for a board-side connector is attached, is caused partly depending on the connection state between the shield member and connector metal shell. Moreover, the connection state from the metal shell of the cable-side connector, to which the shield member is connected, to the metal shell of the board-side connector may become unstable particularly when the number of pins increases to provide elongated connectors.

This non-stability may be promoted by a distortion that occurs when the cable-side connector is fitted with the board-side connector.

SUMMARY OF THE INVENTION

The present invention has been made in view of the above problems, and has as its object to provide a shielded cable connector and an electronic device that can stabilize electrical connection between a cable-side shield member and a board-side GND (ground) pattern.

In order to solve the above problems and to achieve the above object, a shielded cable connector according to the first aspect of the present invention is characterized by having the following arrangement.

More specifically, there is provided a shielded cable connector to be mounted on a shielded cable having a signal transmission line and a shield member therearound, comprising a metal outer shell member to come into direct contact with the shield member, the outer shell member comprising a contact portion extended to come into direct contact with a ground pattern of an electric board to which the shielded cable is to be connected.

A shielded cable connector according to the second aspect of the present invention is characterized by having the following arrangement.

More specifically, there is provided a shielded cable connector to be mounted on a shielded cable having a signal transmission line and a shield member therearound, comprising a metal outer shell member to come into direct contact with the shield member, the outer shell member being in direct contact with a connector for an electric board to which the shielded cable is to be connected.

A shielded cable connector according to the third aspect of the present invention is characterized by having the following arrangement.

More specifically, there is provided a shielded cable connector to be mounted on a shielded cable having a signal transmission line and a shield member therearound, characterized by comprising a metal outer shell member to come into direct contact with the shield member, the outer shell member being in direct contact with a metal housing to which a connector for an electric board, to which the shielded cable is to be connected, is attached.

An electronic device according to the present invention is characterized by having the following arrangement.

More specifically, the electronic device uses the shielded cable connector described above.

The same structure as this is apparently effective even in an ordinary cable connector for transmitting an electrical signal to a connector for a printed wiring board.

Other features and advantages besides those discussed above shall be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

The embodiments of the present invention will be described hereinafter.

First, the outline of the embodiments will be described.

According to the embodiments, of a shielded cable with a connector, part of an outer shell metal member (outer shell) serving as an outer shell member for a cable-side connector which is connected to a shield member is extended over the fitting portion with a board-side connector, to come into direct contact with the GND (ground) pattern of the board. In this case, when the connector is to be inserted or pulled out, the outer shell extension structure should not interfere with the board-side connector. Therefore, the outer shell extension structure desirably has a spring property. Alternatively, it is also effective to attach a gasket to the distal end (the contact portion with the GND pattern of the board) of the extension structure, so the outer shell extension structure has a flexibility. The printed wiring board which is to receive the outer shell extension structure must have a GND pattern surface at a portion where the outer shell extension structure is to reach. The solder resist of this portion must be removed to expose the conductor.

Hence, the shield member and the GND pattern of the board can be electrically connected to each other well and stably through the outer shell metal member (outer shell) of the cable-side connector without passing through a plurality of metal members.

Assume that the metal shell of the board-side connector is connected to the GND of the board well by soldering. In this case, the same effect may be obtained by causing the outer metal member (outer shell of the cable-side connector to come into direct contact with the metal shell of the board-side connector or with a metal housing to which the metal shell of the board-side connector is attached. Furthermore, when the metal shell of the cable-side connector is formed of an integral metal member, connection can be further strengthened including connection of the fitting portion with the board-side connector.

Structures for a shielded cable with a connector and a printed wiring board mounted with a board-side connector according to several embodiments of the present invention will be described with reference to the accompanying drawings.

First Embodiment

Figure 1:
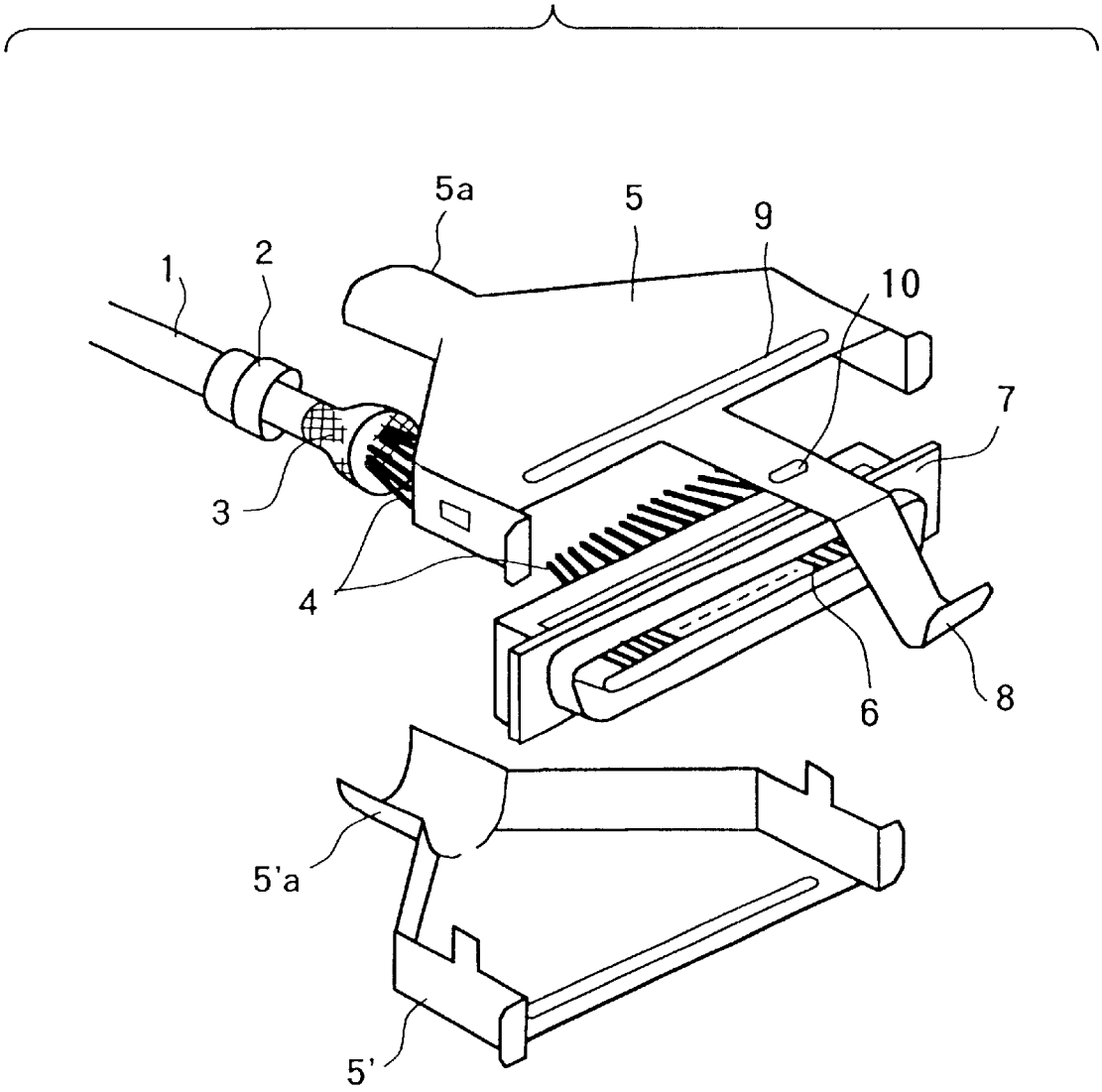
FIG. 1 is a perspective view showing a cable and cable-side connector according to the first embodiment of the present invention.
Figure 2:
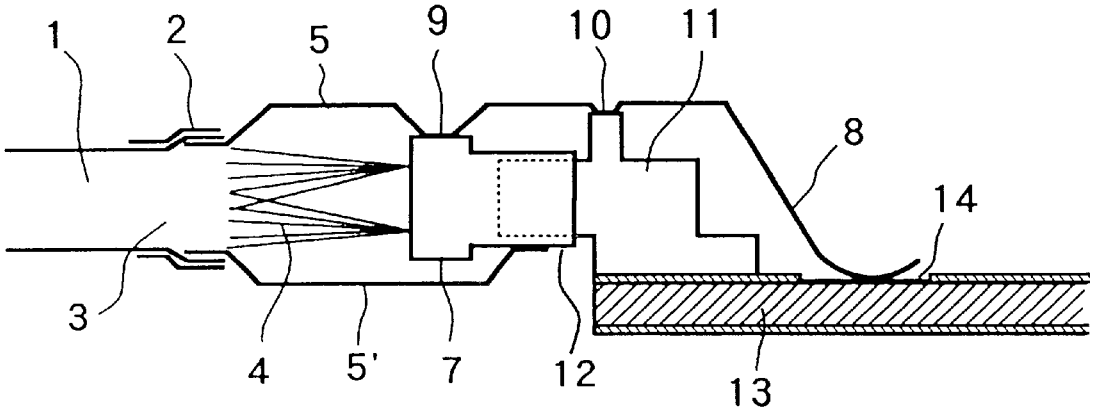
FIG. 2 is a sectional view showing the fitting state between the cable-side connector and a board-side connector according to the first embodiment of the present invention.
Figure 3:
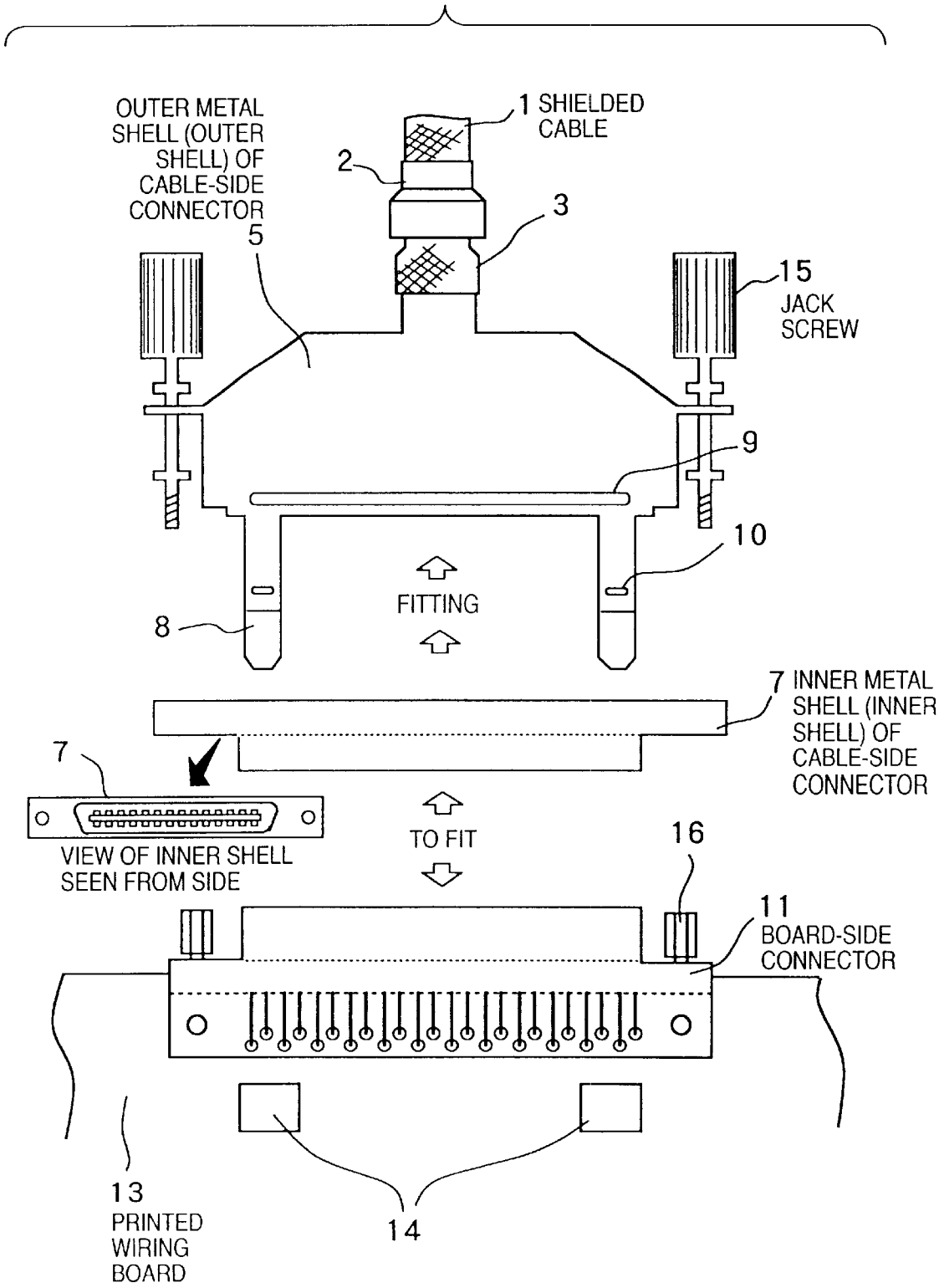
FIG. 3 is an exploded view, seen from above, of the cable, the cable-side connector, the board-side connector, and a printed wiring board according to the first embodiment of the present invention.

FIGS. 1 to 3 are a perspective view, a sectional view, and an exploded view seen from above, respectively, showing the first embodiment of the present invention.

Referring to FIGS. 1 to 3, a shield member 3 of a shielded cable 1 covers cable-side projections 5*a* and 5'*a* of outer shell metal members (outer shells) 5 and 5', serving as the outer shell members, of the cable-side connector, and is pressurized by caulking, with a ferrule member 2 from the outside of its covering portion, to obtain physical and electrical connection. The ferrule member 2 is a cylindrical metal member and caulks the end of the shield member 3 from the outside to fix the end of the shield member 3 to the outer shells 5 and 5' and to electrically connect the shield member 3 and outer shells 5 and 5' to each other. When the ferrule member 2 is used, the electrical connection between the shield member 3 and the outer shells 5 and 5' is stabilized much better, and the EMI (radiation noise) characteristics are improved.

Cable wires 4 for transmitting a signal are directly connected to connector electrodes 6 incorporated in an inner metal member (inner shell) 7 of the cable-side connector. Actually, the inner shell 7 is connected to a board-side connector 11 through a fitting connecting portion 12. In the connector with this arrangement, conventionally, a shield member 3 is connected to GND patterns 14 of a printed wiring board 13 through a plurality of contacts as follows. More specifically, the shield member 3 of a shielded cable 1, an outer shell 5, an inner shell 7, a board-side connector 11, and the GND patterns 14 of the printed wiring board 13 (or the metal housing to which the board is attached) are connected in this order. Hence, connection performance among these members poses a problem. In contrast to this, according to this embodiment, the structure of the outer shell 5 is devised to ensure the connection performance along the members described above electrically sufficiently and stably.

More specifically, part of that side of the outer shell 5 which faces the board-side connector 11 extends as a contact portion 9 to the inner shell 7 and a contact portion 10 to the board-side connector 11 to form an extended spring-like spring structure 8. GND patterns 14 from which solder resists are removed are prepared in the vicinities of that portion of a printed wiring board 13 where the spring-like structure 8 is to reach. When the spring-like structure 8 and GND patterns 14 of the board come into contact with each other, the outer shell 5 and the GND patterns 14 of the board are directly, electrically connected to each other. Hence, the shield member 3 of the shielded cable 1 and the GND patterns 14 of the printed wiring board 13, and furthermore the inner shell 7 of a cable-side connector and the board-side connector 11 are connected to each other well through the outer shell 5 of the cable-side connector. When jack screws 15 are attached to the cable-side connector, they are screwed into and fixed to hexagon nuts 16 attached to the board-side connector. This aids the extended spring-like structure 8 of the outer shell 5 to reliably reach that position of the GND patterns 14 of the board where the resist is removed.

In contrast to this, according to the prior art, due to deformation (distortion in shape) of the inner shell 7, which occurs since the inner shell 7 of the cable-side connector and the board-side connector 11 fit with each other, the connection performance of a contact portion 9 between the inner shell 7 and outer shell 5 and that of a fitting connecting portion 12 between the inner shell 7 and the board-side connector become unstable. Therefore, it is difficult to obtain electrically sufficient and stable connection from the shield member 3 to the GND patterns 14.

Second Embodiment

Figure 4:
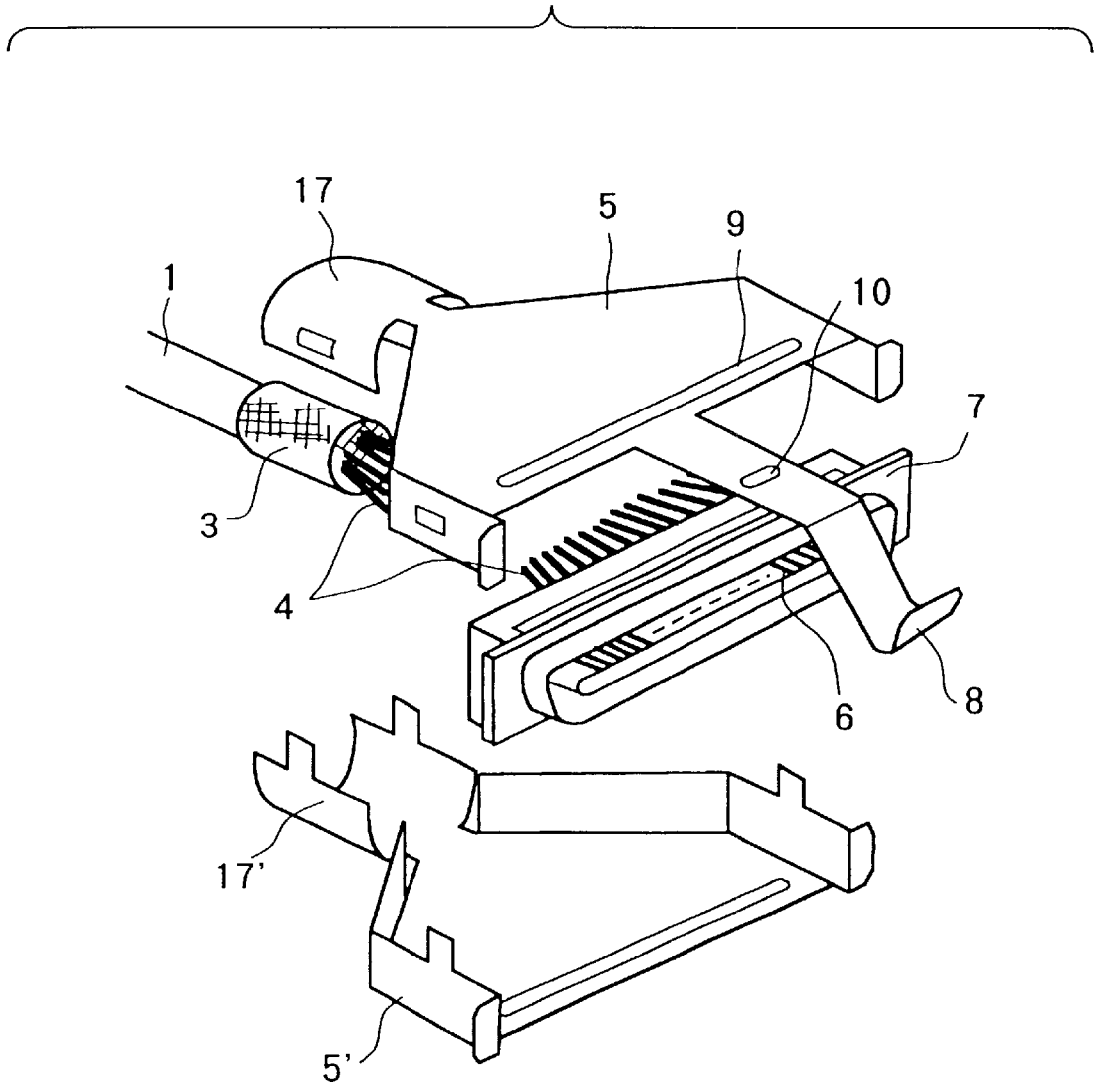
FIG. 4 is a perspective view showing a cable and cable-side connector according to the second embodiment of the present invention.

FIG. 4 shows the second embodiment of the present invention. According to the first embodiment, the shield member 3 of the shielded cable 1 and the outer shell metal members (outer shells) 5 and 5' of the cable-side connector are connected in accordance with contact bonding while caulking with the ferrule member 2. In contrast to this, the second embodiment employs a clamp structure 17 in which cable-side projections of outer shells 5 and 5' clamp a shield member 3 of the shielded cable 1 to cover it from the outside. When the clamp structure 17 is caulked, the shield member 3 and the outer shells 5 and 5' are physically and electrically connected to each other.

Third Embodiment

Figure 5:
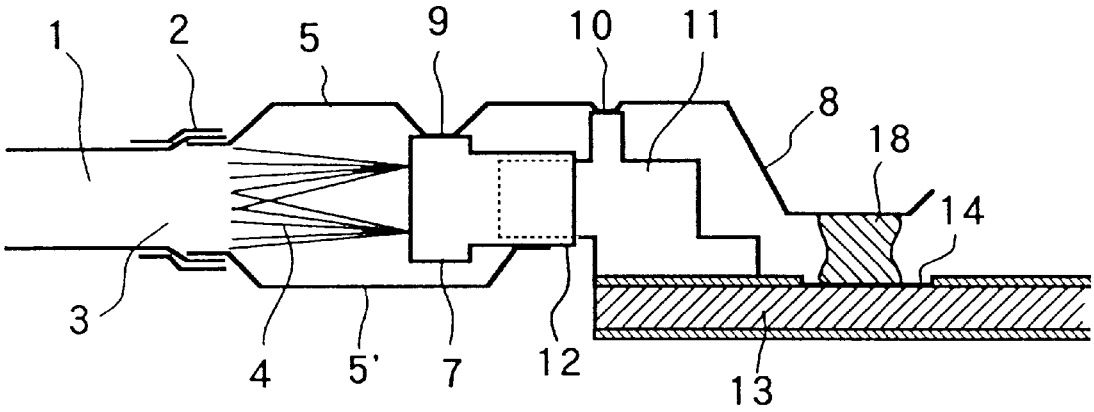
FIG. 5 is a sectional view showing the fitting state between a cable-side connector and board-side connector according to the third embodiment of the present invention.

FIG. 5 shows the third embodiment of the present invention. According to the first embodiment, the spring-like structure 8 extended from the outer shell metal member (outer shell) 5 of the cable-side connector over the board-side connector 11 is in direct contact with the exposed GND patterns 14, which are prepared on the printed wiring board 13 and from which the solder resists are removed, by utilizing the spring property. In contrast to this, according to the third embodiment, a gasket 18 is attached to the lower surface of the distal end of an outer shell extended structure 8 to serve as an auxiliary member when a good spring property cannot be expected for the material of an outer shell 5. Thus, the outer shell extended structure 8 is physically and electrically connected to exposed GND patterns 14 reliably.

In the above description, the gasket 18 is attached to the outer shell. It is obvious that even when the gasket 18 is attached to the exposed GND patterns 14 of the printed circuit board, the same effect as that described above can be obtained.

Fourth Embodiment

Figure 6:
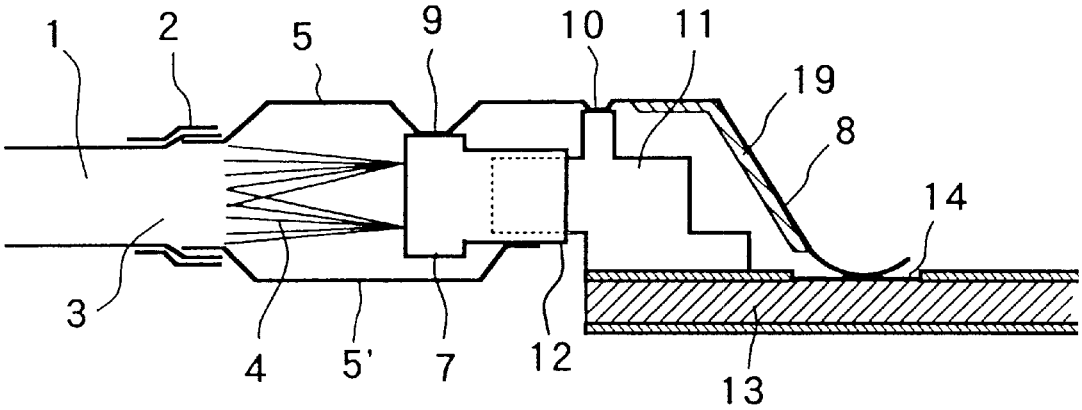
FIG. 6 is a sectional view showing the fitting state between a cable-side connector and board-side connector according to the fourth embodiment of the present invention.

FIG. 6 shows the fourth embodiment of the present invention. In the fourth embodiment, of an outer shell metal member (outer shell) 5 of the cable-side connector, that inner surface of a spring-like structure 8 extended over a board-side connector 11, which is identical to that of the first embodiment, is coated with an insulating material 19 in order to prevent connector pins from coming into contact with the spring-like structure 8. This can prevent the circuit from destruction caused by short circuit of the respective pins to the outer shell 5 which is basically at the GND potential and by short circuit of the respective pins through the outer shell.

Fifth Embodiment

Figure 7:
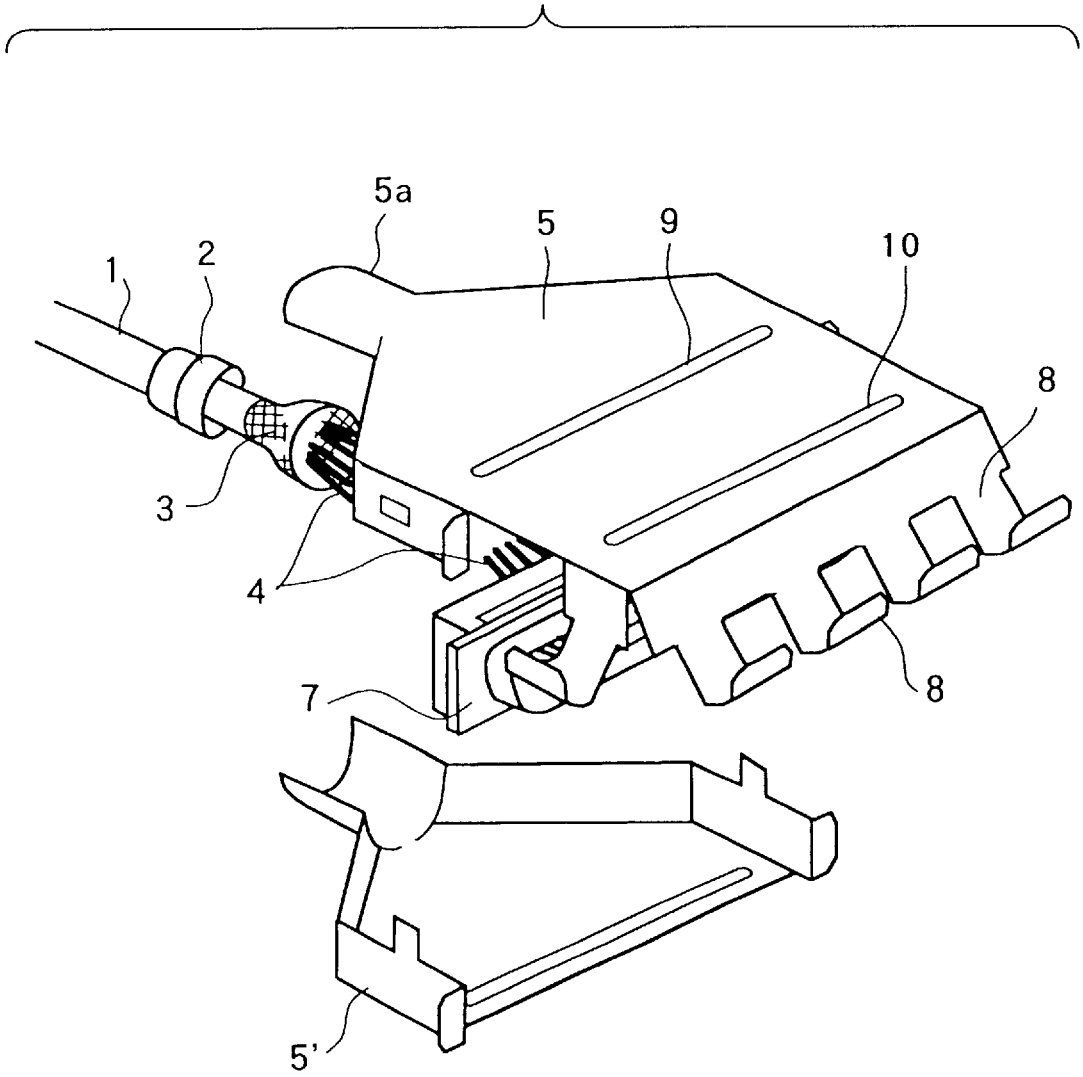
FIG. 7 is a perspective view showing a cable and cable-side connector according to the fifth embodiment of the present invention.

FIG. 7 shows the fifth embodiment of the present invention. According to the first embodiment, of the outer shell metal member (outer shell) 5 of the cable-side connector, the spring-like structure 8 extended over the board-side connector 11 has an extension only at one or two very limited portions for the only purpose of connection. In contrast to this, according to the fifth embodiment, a structure 8 shields a board-side connector 11 by covering it. This prevents noise generated by the printed wiring board pattern or a device such as an IC mounted on the printed wiring board from undesirably being superposed on the pins of the board-side connector 11. In particular, when no metal housing for attaching the board-side connector is used, a noise suppressing effect can be expected because of the absence of the pig-tail portion of the cable.

Sixth Embodiment

Figure 8:
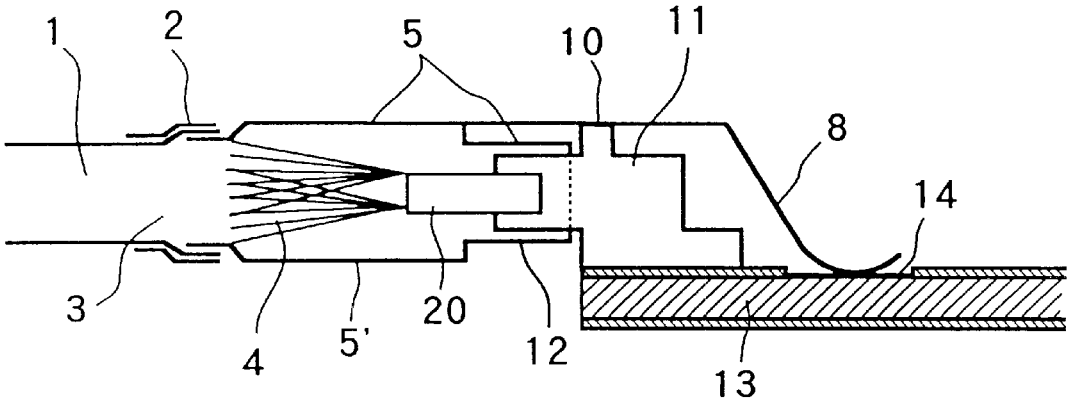
FIG. 8 is a sectional view showing the fitting state between a cable-side connector and board-side connector according to the sixth embodiment of the present invention.

FIG. 8 shows the sixth embodiment of the present invention. The cable-side connector is divided into the outer shell metal members (outer shells) 5 and 5' and inner metal member (inner shell) 7 in the first embodiment, but they are integrated in the sixth embodiment. An upper outer shell 5 extends over a board-side connector 11 to form a spring-like structure 8. This is the same as in the first embodiment. Since a factor that makes connection between the outer and inner shells unstable is eliminated, connection with the board-side connector 11 at the fitting portion is expected to largely contribute to the entire connection.

Seventh Embodiment

Figure 9:
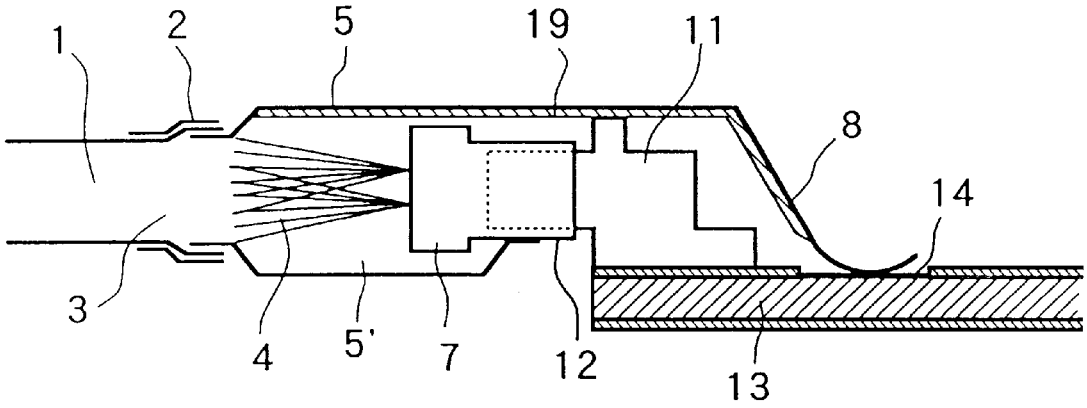
FIG. 9 is a sectional view showing the fitting state between a cable-side connector and board-side connector according to the seventh embodiment of the present invention.

FIG. 9 shows the seventh embodiment of the present invention. According to the first embodiment, the outer shell metal member (outer shell) 5 of the cable-side connector extends over the board-side connector 11 to form the spring-like structure 8. The spring-like structure 8 is in contact with the exposed GND patterns 14 on the printed wiring board to be connected to them. Simultaneously, the outer shell 5 is also in contact with the inner metal member (inner shell) 7 of the cable-side connector and the board-side connector 11 to be connected to them. In contrast to this, in the seventh embodiment, the inner surface of an outer shell 5 is coated with an insulating material 19 so the outer shell does not come into contact with an inner shell 7 or board-side connector 11.

Eighth Embodiment

Figure 10:
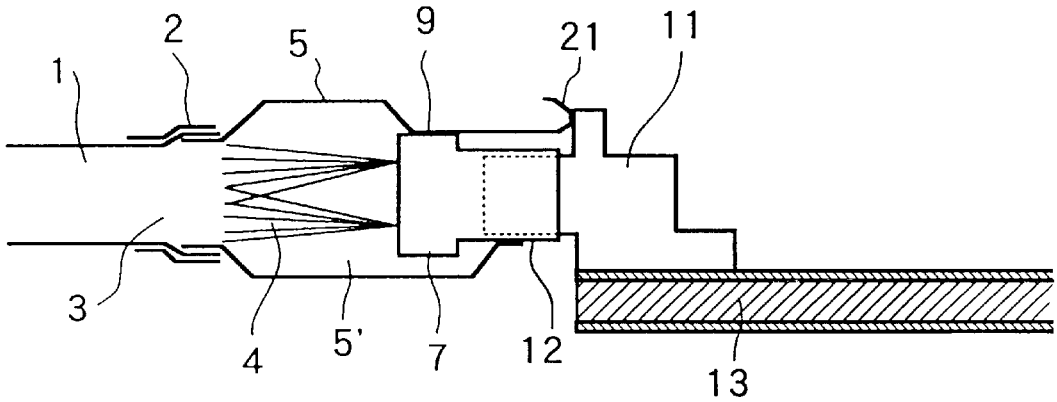
FIG. 10 is a sectional view showing the fitting state between a cable-side connector and board-side connector according to the eighth embodiment of the present invention.
Figure 11:
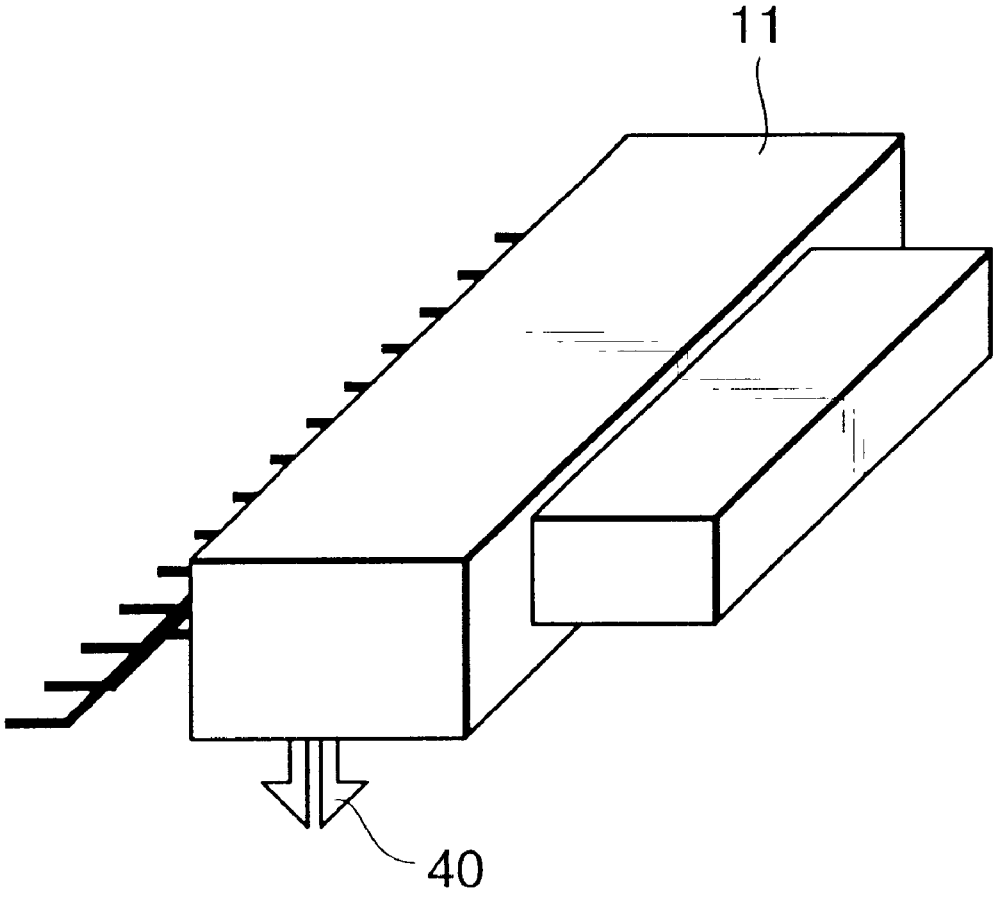
FIG. 11 is a perspective view showing the board-side connector according to the eighth embodiment of the present invention.

FIG. 10 shows the eighth embodiment of the present invention. According to the first embodiment, the outer shell metal member (outer shell) 5 of the cable-side connector extends over the board-side connector 11 to form the spring-like structure 8. The spring-like structure 8 is in contact with the exposed GND patterns 14 on the printed wiring board to be connected to them. Hence, the outer shell 5 is in direct contact with the cable shield member 3 and the exposed GND patterns 14 on the board to be connected to them. In contrast to this, the eighth embodiment has a spring-like structure 21 in which an extended outer shell 5 toward the board-side connector is terminated at that position where it is in contact with a board-side connector 11. In this case, as shown in FIG. 11, this embodiment is made on the following premise. Part of the metal shell of the board-side connector 11 serves as a positioning/fixing pin 40, and the positioning/fixing pin 40 is inserted in a positioning hole formed in the printed wiring board and is bonded to the GND pattern of the printed wiring board with solder, so stable connection is ensured. With this structure, the outer shell 5 need not extend over the board-side connector 11, and the cable connector can be inserted and pulled out easily.

Ninth Embodiment

Figure 12:
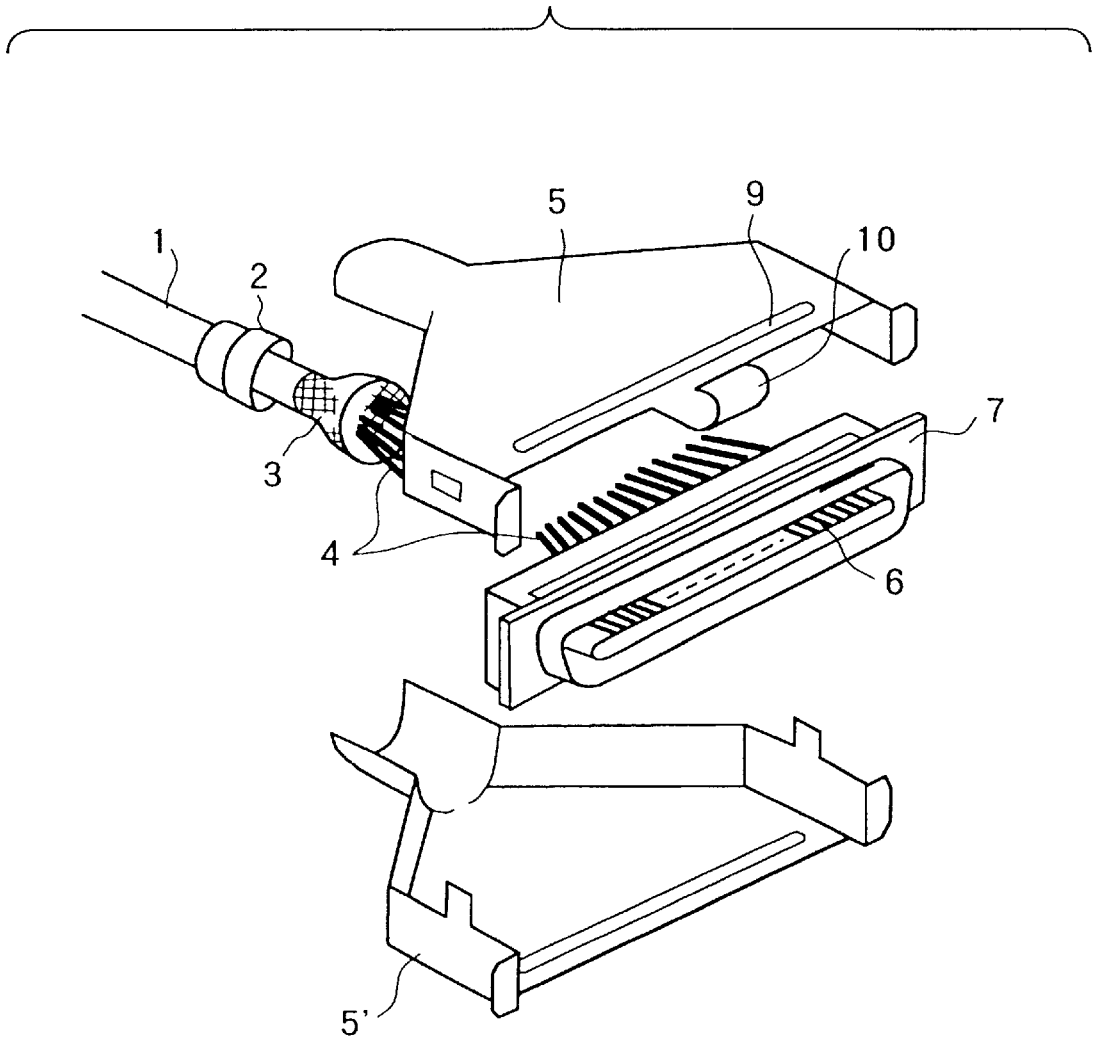
FIG. 12 is a perspective view showing a cable and cable-side connector according to the ninth embodiment of the present invention.
Figure 13:
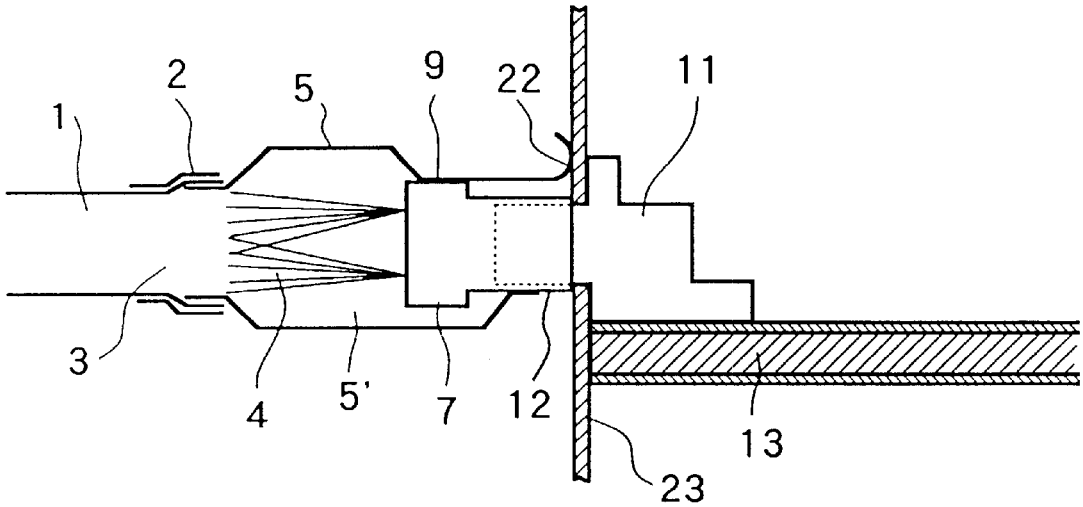
FIG. 13 is a sectional view showing the fitting state between the cable-side connector and a board-side connector according to the ninth embodiment of the present invention.
Figure 14:
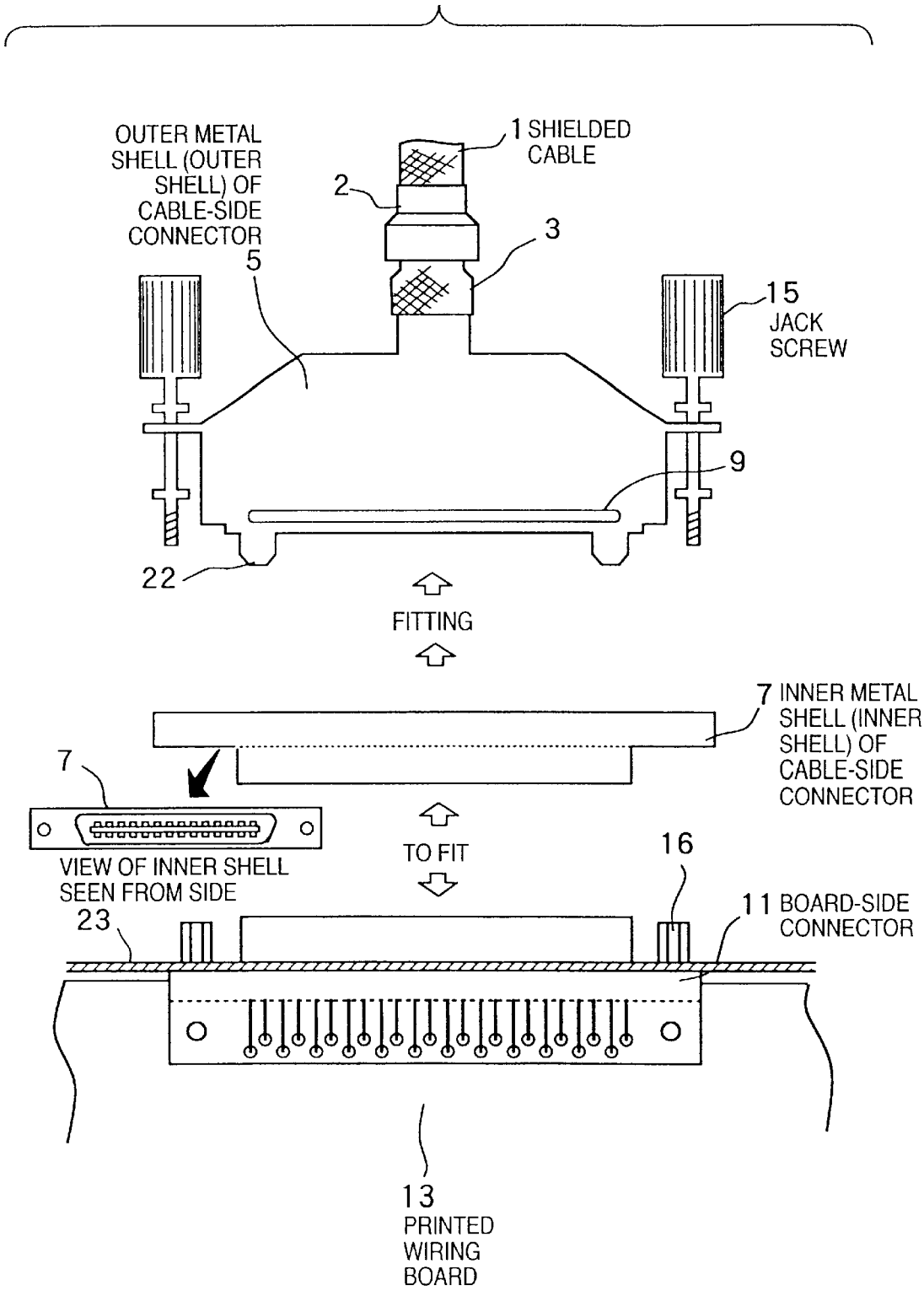
FIG. 14 is an exploded view, seen from above, of the cable, the cable-side connector, the board-side connector, and a printed wiring board according to the ninth embodiment of the present invention.

FIGS. 12 to 14 are a perspective view, a sectional view, and an exploded view seen from above, respectively, showing the ninth embodiment of the present invention. According to the first embodiment, the outer shell metal member (outer shell) 5 of the cable-side connector extends over the board-side connector 11 to form the spring-like structure 8. The spring-like structure 8 is in contact with the exposed GND patterns 14 on the printed wiring board to be connected to them. Hence, the outer shell 5 is in direct contact with the cable shield member 3 and the exposed GND patterns 14 on the board to be connected to them. In contrast to this, the ninth embodiment has a spring-like structure 22 in which an extended outer shell 5 toward the board-side connector is fixed to a board-side connector 11 with hexagon nuts 16 to be in surface-contact with it. The peripheral portions of machine screw fixing holes formed in the board have GND exposed pads. Thus, the extended outer shell 5 is in direct contact with a metal housing 23 by multi-point contact through machine screws.

In this case, part of the metal shell of the board-side connector 11 serves as positioning/fixing pins. The positioning/fixing pins are bonded to the GND patterns of the printed wiring board with solder, so that stable connection is ensured. This is apparent also from the eighth embodiment. With this structure, the outer shell 5 need not extend over the board-side connector 11. Also, the cable connector can be inserted or pulled out without forming defects in the board that also serves to shield the printed wiring board and the connector opening of the board-side connector fixing metal housing 23.

10th Embodiment

Figure 15:
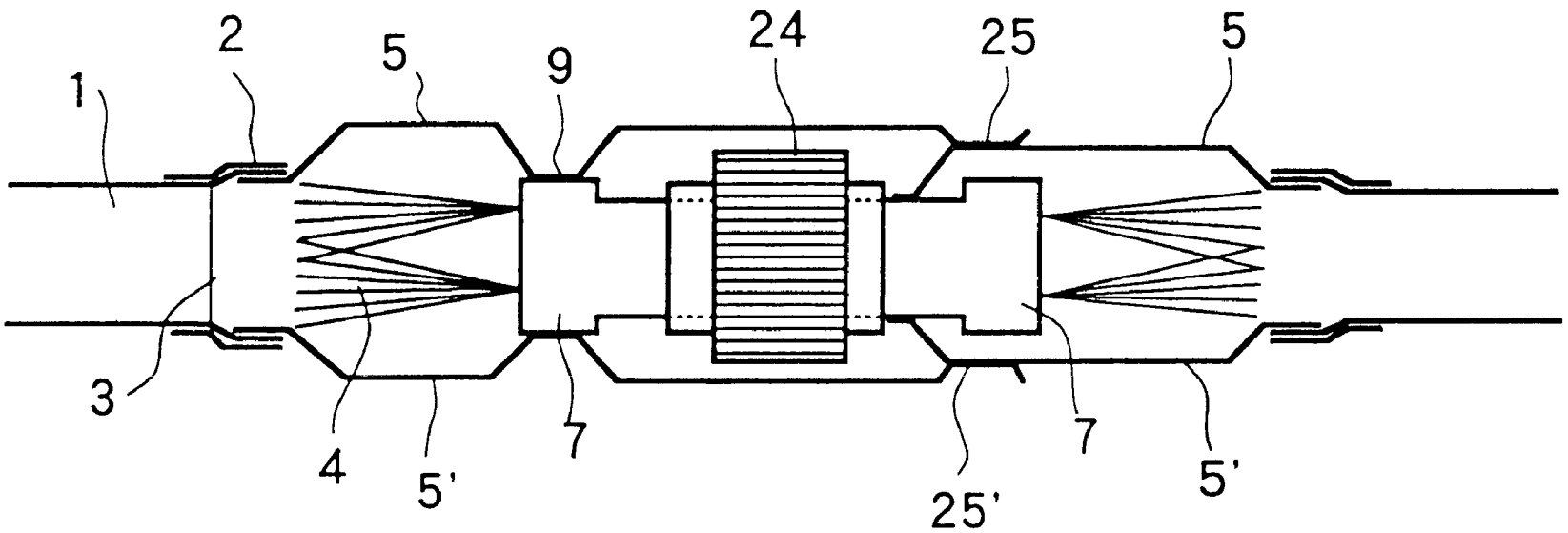
FIG. 15 is a sectional view showing the fitting state between one cable-side connector, a relay connector, and the other cable-side connector according to the 10th embodiment of the present invention.

FIG. 15 shows the 10th embodiment of the present invention. The first to ninth embodiments are related to the bonding portion between the cable and printed wiring board. In contrast to this, the 10th embodiment shows a case related to a cable relay bonding portion where cables are connected to each other through a relay connector 24. An outer shell metal member (outer shell) 5 of one cable-side connector extends over the relay connector 24 to form a spring-like structure 25. The spring-like structure 25 comes into direct contact with an outer shell metal member (outer shell) 5 of the other cable-side connector. The outer shell 5 in direct contact with a shield member 3 of one shielded cable 1 and the outer shell 5 in direct contact with a shield member 3 of the other shielded cable 1 are in direct contact with each other, so the shielded cables are relayed and connected to each other well. In this case, it is also effective to extend the outer shells 5 of the two cable-side connectors, or if the relay connector 24 has a metal shell, to extend the outer shells 5 to such a degree that they are connected to the metal shell. This is apparent from the above description as well.

As has been described above, according to the above embodiments, regarding the structure of the cable-side connector, the metal shell of the cable-side connector comes into direct contact with the shield member of the cable, and extends over the fitting portion with the board-side connector to reach the conductor exposed portions of the GND patterns of the board, thus forming a spring-like structure. Thus, the metal shell of the cable-side connector can come into direct contact with the GND patterns of the board as well. Therefore, electrical connection from the cable shield member to the board GND patterns can be ensured sufficiently and stably. The common mode current flowing through the shield member of the cable is suppressed, and a stable transmission waveform is ensured in signal transmission between units and between boards. Regarding the characteristics of noise emitted as the cable serves as an antenna, the noise can be suppressed to a low level stably.

The above embodiments exhibit several combinations of the structure of the cable-side connector and the connecting portions. Besides these combinations, several other types of combinations are apparently possible.

As has been described above, according to the above embodiments, electrical connection between the cable-side shield member and the board-side GND patterns can be stabilized.

The present invention is not limited to the above embodiments and various changes and modifications can be made within the spirit and scope of the present invention. Therefore, to apprise the public of the scope of the present invention the following claims are made.

What is claimed is:

1. A shielded cable connector to be mounted on a shielded cable having signal transmission lines and a shield member therearound, comprising:

a metal inner shell member having electrodes which are connectable to said signal transmission lines, and said metal shell inner member being connectable to a board-side connector on an electric board; and a metal outer shell member directly contactable with the shield member, the outer shell member comprising a contact portion extended for direct contact with a ground pattern of the electric board to which the shielded cable connector is to be connected.

2. The connector according to claim 1, wherein the contact portion extends over a board-side connector arranged on the electric board and comes into contact with the ground pattern.

3. The connector according to claim 1, wherein the shield member is arranged to surround a projection of the metal outer shell member, and is contact-bonded to the outer shell member from an outside of the shield member with a pipe-shaped member, so the shield member is kept in contact with the outer shell member.

4. The connector according to claim 1, wherein the metal outer shell member has a clamp portion for clamping the shielded cable together with the shield member.

5. The connector according to claim 1, wherein the contact portion has a spring property, and is deformed, when the shielded cable connector is inserted in or pulled from a board-side connector so as not to interfere with the board-side connector.

6. The connector according to claim 1, wherein the contact portion comes into contact with the ground pattern of the electric board through a gasket.

7. The connector according to claim 1, wherein a solder resist coating of the ground pattern has been removed.

8. The connector according to claim 1, wherein the contact portion is formed to cover a board-side connector.

9. The connector according to claim 8, wherein an insulating material is formed on an inner surface of the contact portion.

10. The connector according to claim 1, wherein the contact portion comes into direct contact with said board-side connector as well.

11. The connector according to claim 1, wherein the contact portion comes into direct contact with said inner metal member of the shielded cable connector.

12. The connector according to claim 1, wherein the contact portion does not come into contact with a board-side connector and said inner metal member of the shielded cable connector which comes into direct contact with the board-side connector.

* * * * *